United States Patent [19]

Terada et al.

[11] 4,244,418

[45] Jan. 13, 1981

[54] APPARATUS FOR FORMING VACUUM-SEALED MOULD

[75] Inventors: Hideto Terada; Masanori Yosikawa, both of, Toyokawa, Japan

[73] Assignee: Sintokogio Ltd., Nagoya, Japan

[21] Appl. No.: 8,832

[22] Filed: Feb. 2, 1979

Related U.S. Application Data

[62] Division of Ser. No. 906,878, May 17, 1978, Pat. No. 4,167,206.

[30] Foreign Application Priority Data

May 20, 1977 [JP] Japan ..... 52/59110

[51] Int. Cl.[3] ..... B22C 9/02

[52] U.S. Cl. ..... 164/147; 83/171; 164/160; 493/133

[58] Field of Search ..... 83/171; 93/33 H, DIG. 1; 164/7, 160, 147; 294/64 R

[56] References Cited

U.S. PATENT DOCUMENTS 3,135,077 6/1964 Siegel et al. ..... 93/33 H X
4,009,747 3/1977 Miura et al. ..... 164/7

FOREIGN PATENT DOCUMENTS 1200498 9/1965 Fed. Rep. of Germany ..... 294/64 R
647276 12/1950 United Kingdom ..... 83/171

*Primary Examiner*—Robert D. Baldwin
*Attorney, Agent, or Firm*—Armstrong, Nikaido, Marmelstein & Kubovcik

[57] ABSTRACT

An apparatus for forming a sprue and a communication hole in a vacuum-sealed mould. This method includes steps of: laying a shield film over a pattern and a sprue forming pattern or a communication hole forming pattern; assembling the pattern with a moulding flask; charging a charged material of particulate type into the moulding flask, and laying another shield film over the moulding flask, the charged material and the top portion of the sprue forming pattern or the communication hole forming pattern; welding the two films together along the periphery of the top surface of the sprue forming pattern or the communication hole forming pattern; cutting the two films, thus welded, along the periphery of the top surface of the sprue forming pattern or communication-hole forming pattern; and removing the sprue forming pattern or the communication hole forming pattern through the cut portion of the film. In addition, there is disclosed an apparatus for welding the two films together and cutting the same along the periphery of the top surface of the sprue forming pattern or the communication hole forming pattern.

16 Claims, 4 Drawing Figures

APPARATUS FOR FORMING VACUUM-SEALED MOULD

This is a division of application Ser. No. 906,878, filed May 17, 1978, now U.S. Pat. No. 4,167,206.

This invention relates to an apparatus for forming a sprue or communication-hole in a vacuum shield mould by applying a suction force to a charge material filled in a moulding flask.

It has been a common practice in forming a vacuum-sealed mould that a sprue or a communication-hole is formed by using a melt-away or consumable type pattern, a wooden sprue or communication-hole core-rod having a synthetic resin film wound therearound, or a rod-shaped balloon. However, the first attempt suffers from an increased manufacturing cost, because a costly pattern made of polystyrene resin or the like should be consumed in every casting operation. The second attempt gives a problem that since a sprue or a communication-hole is formed by forcedly pulling a sprue or communication-hole-forming core-rod from a casting mould after the mould has been formed, there is a risk of damaging the formed mould, which is caused by a dragging force between the core rod and the film wound around the core rod upon withdrawal of the rod. Further, it is difficult applying a film to the rod requiring much further time and effort. Furthermore, when a molten metal or melt is poured into the mould thus formed, a joint between the film and another film applied over the formed mould leaves marks on the surface of a product or casting, which marks cause the casting to be defective. Still furthermore, the third attempt offers a difficulty in maintaining the shape of a balloon constant, that is, causes a deformation of the balloon under the pressure of a charge material, or due to a suction force applied thereto, the balloon is likely to be ruptured upon heating.

It is accordingly an object of the present invention to provide a method for forming a sprue or communication hole in a vacuum-sealed mould and an apparatus for forming the mould, which eliminates the disadvantages experienced with the prior art methods and apparatuses of the type described, and permits the use of a sprue or communication-hole-forming pattern which is less costly and repeatedly usable and which provides a stable configuration free of a deformation.

According to the present invention, there is provided a method for forming a sprue or a communication-hole in a vacuum-sealed mould, which comprises the steps of: laying a first shield film over both a pattern plate and a sprue-forming pattern or a communication-hole-forming pattern, and laying a second shield film over both an upper half of a molding flask or a cope and a charge material; welding the aforenoted two films together; cutting the two films welded along the periphery of the top surface of the sprue-forming pattern or communication-hole-forming pattern; removing the cut portion of the both shield films; and removing the sprue forming pattern or communication-hole pattern through the cut-away or removed portion of the films.

Figure 1:
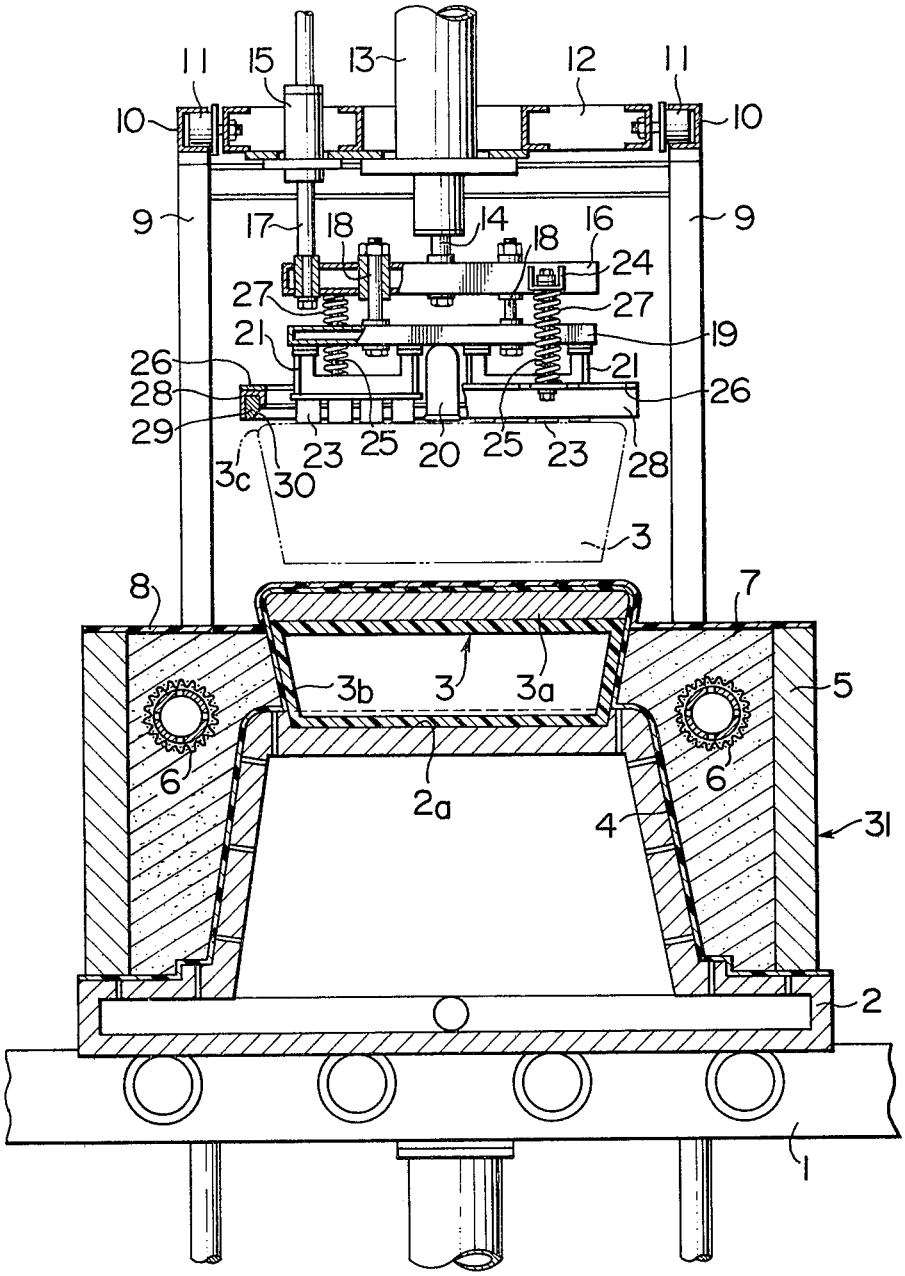
Figure 2:
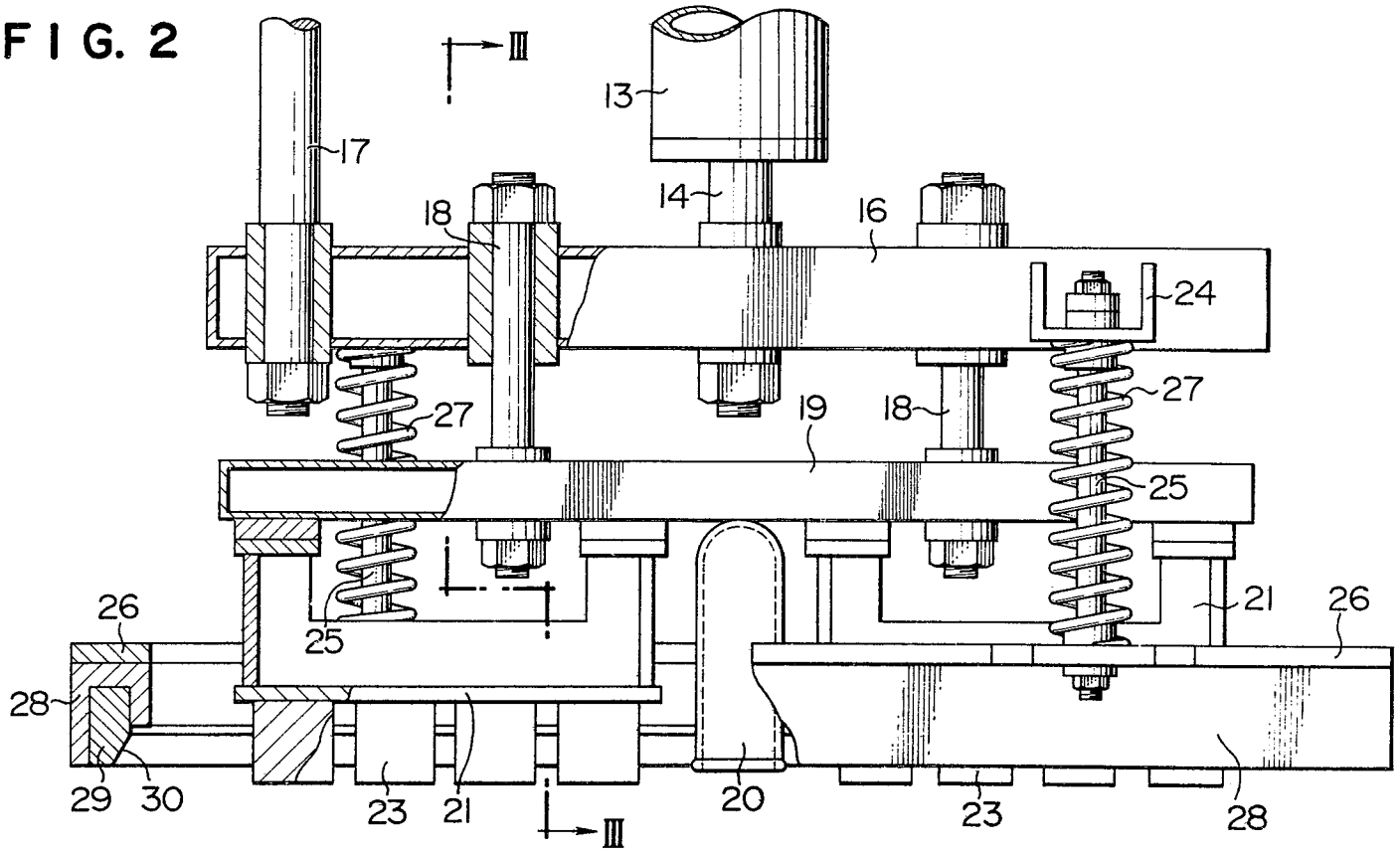
Figure 3:
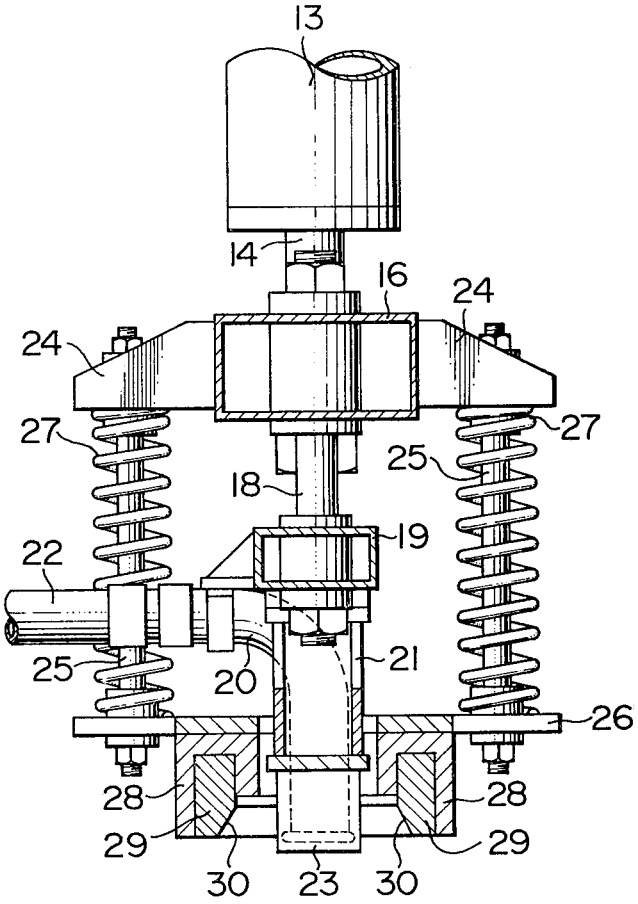
Figure 4:
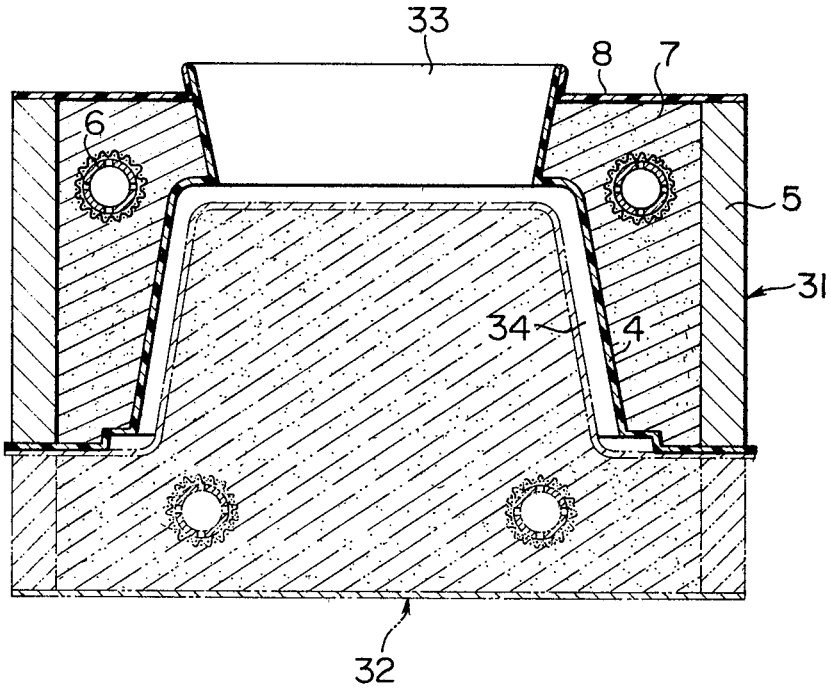

FIGS. 1 through 3 are views illustrative of one embodiment of the present invention, in which FIG. 1 is a side elevation, partly broken, of an embodiment of the invention, FIG. 2 is an enlarged, side elevation of an essential part of the embodiment of FIG. 1, and FIG. 3 is a cross-sectional view of the embodiment, taken along the line III—III of FIG. 2; and FIG. 4 is a cross-sectional view illustrative of an upper half of a moulding flask or a cope (shown by a solid line) according to the present invention, and a lower half of a moulding flask or a drag (shown by a chain line) according to a conventional method.

Shown at 1 in FIG. 1 is a roller conveyor running in the transverse or horizontal direction of FIG. 1, while a pattern plate 2 having pattern is mounted thereon so as to be movable with the conveyor. The pattern plate 2 has a hollow interior and of a convex shape, in which the central portion thereof projects upwards with a rectangular recess 2*a* being provided in the top surface thereof. Fitted in the recess 2*a* is a bottom portion of an elongated sprue-forming pattern 3 extending along the length of the conveyor. The pattern 3 consists of an upper member made of a magnetic material 3*a* and a lower member made of synthetic resin 3*b*. The surfaces of the pattern plate 2 and sprue-forming pattern 3 are covered with a shield member 4, such as a thin synthetic resin film which tends to melt away or be consumed due to the heat of a molten metal. An upper half of a moulding flask or cope 5 is mounted on the pattern plate 2 through the medium of the shield member 4 and has suction pipes 6 introduced therein and communicated with an external suction mechanism (not shown). A charge material 7 of a particulate form is filled in a cavity defined in the cope 5. In addition, the top surface of the sprue-forming pattern 3 is somewhat higher than the top surface of the cope 5, while the top surface of the pattern 3 and cope 5 are covered with another shield member 8, such as a synthetic resin film or the like.

Two gate-type frames 9, 9 are uprightly set in opposed relation to each other on the opposite sides of the roller conveyor 1, while 'U'-shaped cross sectional rails 10, 10 are laid along the both sides of the roller conveyor 1 on the tops of the gate type frames 9, 9 but in opposed relation to each other. Shown at 12 is a carriage movable along the rails 10, 10, with the opposite ends of the carriage being journaled in rollers 11, 11 fitted in rails 10, 10, respectively. A cylinder 13 having a piston rod 14 extending therefrom downwards is secured to the carriage 12 so as to extend through the central portion thereof in the vertical direction. A guide sleeve 15 is provided in parallel with the cylinder 13 (on the left-hand side in FIG. 1). In addition, the tip of the piston rod 14 is coupled to a substantially central portion of an upper frame 16. A guide rod 17 is provided upright on the upper frame 16 in the position close to the periphery of the frame 16, the aforenoted rod 17 being slidable through the guide sleeve 15 and serving as a means for preventing the horizontal rotation of the frame 16. In addition, guide rods 18, 18 are so mounted to the upper frame 16 so as to be movable up and down, while a lower frame 19 is carried by the lower ends of the guide rods 18, 18. Positioned in the central portion of the undersurface of the lower frame 19 is a suction pipe 20 communicating with a vacuum source (not shown) via a hose 22, as shown in FIG. 3, while brackets 21, 21 are secured to the front and rear ends of the lower frame 19, as viewed in the direction of the conveyor 1. Four electromagnets 23 are secured to the undersurface of each bracket 21 with the lower end faces of the electromagnet 23 being somewhat projected from the open end of the suction pipe 20. In addition, brackets 24, 24 are secured to the front and rear end surfaces of the upper frame 16 as viewed in the direction of the conveyor 1, while guide rods 25, 25 are suspended from the brackets 24, 24 respectively. An annular attaching plate 26 is secured to the lower ends of the guide rods 25, 25 in a horizontal direction so as to surround the suction pipe 20 and brackets 21, 21 while compression springs 27, 27 are inserted between the brackets 24, 24 and attaching plate 26 so as to surround the guide rods 25, 25, respectively. A heat-insulating supporting member 28 is secured to the undersurface of the attaching plate 26, while a heater 29 is built in the heat-insulating supporting member 28. An inner, inclined surface 30 of the heater 29 is adapted to contact the top peripheral edge of the sprue-forming pattern 3 at the lowermost extremity of a stroke of the heater 29.

Shown at 31 in FIG. 4 is an upper half of a moulding flask or a cope, at 32 a lower half of a moulding flask or a drag, at 33 is a sprue serving as a communication-hole, and at 24 a cavity defined by the cope 31 and drag 32.

Description will be given of the operation of the apparatus according to the present invention.

FIG. 1 shows a condition where a wheeled-carriage-driving cylinder (not shown) is operated so as to move the wheeled carriage 12 right above the cope 5. In this condition, after the heater 29 has been energized, the cylinder 13 is operated so as to lower the upper frame 16 and lower frame 19. Then, since the electromagnets 23 are located in the lowermost position, so that the electromagnets 23 are brought into contact with the shield members 4, 8 covering the top surface of the sprue-forming pattern 3, and then stopped thereat. The further operation of the cylinder 13 causes the upper frame 16 to be lowered along the guide pins 18, 18 until the inner, inclined surface 30 of the heater 29 contacts a top peripheral edge portion 3*c* of the sprue-forming pattern 3. The forces of the compression spring 27 are exerted on the shield member 4, 8 through the inclined surface 30. At this time, the heater 29 remains in a heated condition so that the shield members 4, 8 are welded together in a loop along the top peripheral portion 3*c* by means of the inclined surface 30 of the heater 29 while portions of the shield members 4, 8 are cut off along the welded loop. At this time, an electric power source for the heater 29 is turned off, while the electromagnets 23 are energized. Then, when the cylinder is retracted so as to pull the upper frame 16 upwards, then the sprue-forming pattern 3 is detached away from the inclined surface 30, and then the sprue-forming pattern 3 is pulled out of the pattern plate 2 and shield member 4, while being attracted to the electromagnets 23. The sprue-forming pattern 3 can be easily pulled out by means of electromagnets 23 as mentioned the above because the sprue-forming pattern has a tapered configuration or a draft angle thereof as shown in FIG. 1 and the top surface thereof is made of a magnetic member 3*a*.

Subsequently, the cope 31 having the pattern plate 2, from which the sprue-forming pattern 3 has been pulled out, is then delivered to the succeeding step by means of the roller conveyor 1 so as to be separated from the pattern plate 2, after which the cope 31 is mated with the drag 32 formed on another mould-forming line, and then a mould assembly such as that shown in FIG. 4 is completed. It is needless to mention that the shield members 4, 8 are maintained in welded condition along the top periphery of the sprue 33.

In the succeeding step, a fresh pattern plate 2 is transported or introduced by means of the roller conveyor 1 so as to be positioned just below the sprue-forming pattern suspended by means of the electromagnets 23. At this time, a piston is extended from the cylinder 13 so as to lower the sprue-forming pattern 3 and then to fit the lower portion of the pattern plate 2 into the recess 2*a* provided in the top surface of the pattern plate 2. Then, after an electric power source for the electromagnets 23 has been turned off, a vacuum source (not shown) is operated so as to remove shield members 4, 8 left on the top surface of the sprue-forming plate 3 through the suction pipe 20 outside. Thereafter, when the piston has been retracted into the cylinder 13 so as to lift the upper frame 16, the carriage 12 is moved so as to move away from the position above the pattern plate 2. At this time, the shield member 4 which has been heated and softened by a heater (not shown) is laid over the surfaces of the sprue-forming pattern 3 and pattern plate 2 under a vacuum applied to the interior of the pattern plate 2 so that the shield member 4 may intimately come in contact with the surfaces of the sprue-forming plate 3 and pattern plate 2. Then, the cope 5 is mounted on the pattern plate 2, after which the charge material 7 of a particulate form is charged in a cavity in the mould. After the charging of the charge material 7, the shield member 8 is laid over the top surface of the cope 5 with the aid of a vacuum force. When the carriage 12 is moved to a position above the cope 5, there may be resumed a condition as shown in FIG. 1. In this manner, the aforenoted sequence of operations is repeated.

As far as described hereinbefore, the heater 29 is provided for welding and cutting simultaneously the shield members 4, 8, however, a cutting heater is separately provided inward of the heater 29 so as to have the heater 29 served as a welder alone. An electric power source for the heater 29 should not necessarily be turned on and off every time required, but may be maintained on. In addition, the sprue forming plate 3 should not necessarily be pulled by utilizing an attracting force of the electromagnets 23, but may be pulled by vacuum source or the like. However, in this case, the cut-off portion of the shield member 48 should be removed, before the removal of the sprue forming pattern plate 3. In addition, the process according to the present invention has been explained in the formation of the sprue 33 by means of the sprue-forming pattern 3 but this process is also applied to a communication-hole by using a communication-hole-forming pattern in a similar manner to that applied to the sprue-forming pattern.

As is apparent from the foregoing description of the apparatus according to the present invention, shield member covering the top surface of a sprue-or a communication-hole-forming pattern is welded together and cut along the periphery of the sprue or the communication-hole, after which the sprue-or communication-hole-forming pattern is pulled out, thereby the sprue-or communication-hole forming pattern may be automatically positively pulled out without damaging the mould. In addition to this, the sprue-or communication-hole-forming pattern less costly and of a stable shape may be employed, thus providing remarkable advantages in this field of the industry.

We claim:

1. An apparatus for forming a mould cavity having a communication hole comprising a charged moulding flask containing a mould cavity forming pattern and a lower portion of a communication hole forming pattern disposed thereon, a first shield member overlaying said mould cavity forming pattern and said communication hole forming pattern, a second shield member overlaying said charged moulding flask and that part of said first shield member overlaying the top portion of said communication hole forming pattern, means adapted for welding and cutting said first and said second shield members along a coincident periphery, said periphery surrounding the top surface of said top portion.

2. An apparatus for forming a mould cavity having a communication hole, wherein a first shield member conformingly covers a communication hole forming pattern and the surface of a mould cavity forming pattern, the hole forming pattern being disposed on the cavity forming pattern and having a top surface with a periphery; a moulding flask surrounds the first shield member, the cavity forming pattern, and a portion of the hole forming pattern, the flask being filled with a mould material; and a second shield member covers the surfaces of the moulding flask, the mould material, and the top portion of the hole forming pattern and is in intimate contact with the first shield member over the top portion of the hole forming pattern;

said apparatus further comprising:

means for welding and cutting said first and second shield members along the periphery of the top surface of the hole forming pattern.

3. An apparatus as set forth in claim 2 wherein said top portion is made of a magnetic material, further comprising means for electromagnetically lifting said hole forming pattern from said cavity forming pattern following operation of said welding and cutting means.

4. An apparatus as set forth in claim 2 wherein said welding and cutting means comprises a heater in a loop having a shape corresponding to the periphery of the top surface of said hole forming pattern.

5. An apparatus as set forth in claim 2 wherein said welding and cutting means comprises a welding heater in a loop corresponding to the periphery of the top surface of said hole forming pattern, and a cutting heater in a loop disposed inside of said welding heater.

6. An apparatus as set forth in claim 2, further comprising means for removing by suction the cut portions of said first and second shield members.

7. An apparatus as set forth in claim 6, wherein said suction removing means is disposed in said welding and cutting means.

8. An apparatus as set forth in any one of claims 4 to 7 or 2, further comprising means for raising and lowering said welding and cutting means operatively associated with said welding and cutting means.

9. An apparatus for forming a mould cavity having a communication hole, wherein a first shield member conformingly covers a communication hole forming pattern and the surface of a mould cavity forming pattern, the hole forming pattern being disposed on the cavity forming pattern and having a top surface with a periphery, a moulding flask surrounds the first shield member, the cavity forming pattern, and a portion of the hole forming pattern, the flask being filled with a mould material; and a second shield member covers the surfaces of the moulding flask, the mould material, and the top portion of the hole forming pattern and is in intimate contact with the first shield member over the top portion of the hole forming pattern;

said apparatus further comprising;

a gate frame disposed above the moulding flask;

vertically movable frame means;

means mounted on said gate frame for vertically moving said frame means attached to said frame means; and means for welding and cutting said first and second shield members along the periphery of the top surface of the hole forming pattern mounted on said frame means.

10. An apparatus as set forth in claim 9 further comprising means for holding the cut portions of the first and second shield members when said means for vertically moving said frame means moves upwardly, said means for holding being mounted on said frame means.

11. An apparatus as set forth in claim 10 wherein said means for holding comprises means for applying suction to the cut portions.

12. An apparatus as set forth in claim 9 further comprising means for removing the hole forming pattern attached to said frame means.

13. An apparatus as set forth in claim 12 wherein the top portion of said hole forming pattern is made of a magnetic material and said means for removing comprises electromagnetic means and means for energizing said electromagnetic means.

14. An apparatus as set forth in claim 9 further comprising guide means attached to said frame means and interacting with said gate frame for preventing rotational movement of said frame means.

15. An apparatus as set forth in any one of claims 9–14 wherein said means for welding and cutting comprises an annular heater conforming to the periphery of the top surface.

16. An apparatus as set forth in any one of claims 9–14 wherein said means for welding and cutting comprises an annular welding heater conforming to the periphery of the top surface, and an annular cutting heater disposed radially inward of said welding heater.

* * * * *